US007270157B2

(12) United States Patent
Perkitny

(10) Patent No.: US 7,270,157 B2
(45) **Date of Patent: *Sep. 18, 2007**

(54) WASTE COLLECTION DEVICE

(75) Inventor: Jerzy Perkitny, 17810 Lake Rd., Lakewood, OH (US) 44107

(73) Assignee: Jerzy Perkitny, Lakewood, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/377,045

(22) Filed: Mar. 16, 2006

(65) Prior Publication Data

US 2006/0180233 A1 Aug. 17, 2006

Related U.S. Application Data

(63) Continuation-in-part of application No. 10/811,103, filed on Mar. 26, 2004, now Pat. No. 7,077,172.

(60) Provisional application No. 60/662,832, filed on Mar. 17, 2005, provisional application No. 60/476,686, filed on Jun. 6, 2003, provisional application No. 60/458,594, filed on Mar. 28, 2003.

(51) Int. Cl.
*B65B 1/04* (2006.01)

(52) U.S. Cl. ..... 141/114; 141/10; 141/313; 294/1.3

(58) Field of Classification Search ..... 141/10, 141/114, 313, 391, 108, 110; 294/1.3–1.5, 294/55; 53/390
See application file for complete search history.

(56) References Cited

U.S. PATENT DOCUMENTS

| | | | |
|---|---|---|---|
| 741,195 | A | 10/1903 | Voelker |
| 744,338 | A | 11/1903 | Hall |
| 937,754 | A | 10/1909 | Bartels |
| 2,486,434 | A | 11/1949 | Plummer |
| 3,744,453 | A | 7/1973 | Deitch |

(Continued)

FOREIGN PATENT DOCUMENTS

| | | |
|---|---|---|
| FR | 2650608 | 2/1991 |

(Continued)

*Primary Examiner*—Steven O. Douglas
(74) *Attorney, Agent, or Firm*—Fay Sharpe LLP

(57) ABSTRACT

An improved waste collection device includes a body having a housing defining an opening which allows an open end of an associated bag to be folded thereover. The housing receives a closed end of the associated bag therein. A spool is rotatably connected to the body and removably connected to the associated bag. A driving mechanism is connected to the spool for selectively rotating the spool such that the associated bag is wound on the spool thereby pulling the associated bag into the housing.

26 Claims, 14 Drawing Sheets

U.S. PATENT DOCUMENTS

| | | | |
|---|---|---|---|
| 3,804,448 | A | 4/1974 | Schmieler |
| 3,819,220 | A | 6/1974 | Bredt |
| 3,868,135 | A | 2/1975 | Magliaro |
| 3,977,422 | A | 8/1976 | Cabaluna |
| 4,078,838 | A | 3/1978 | Nadratowski |
| 4,185,355 | A | 1/1980 | Williams |
| 4,201,409 | A | 5/1980 | O'Hara |
| 4,253,691 | A | 3/1981 | Liu |
| 4,447,082 | A | 5/1984 | Lindholm |
| 4,477,111 | A | 10/1984 | Crooks |
| 4,478,448 | A | 10/1984 | Albert |
| 4,641,873 | A | 2/1987 | Nurnberger |
| 4,819,977 | A | 4/1989 | Cooper |
| D310,436 | S | 9/1990 | Krauth |
| 4,995,661 | A | 2/1991 | Aurness et al. |
| 5,156,427 | A | 10/1992 | Longrie et al. |
| D333,888 | S | 3/1993 | Visser |
| D336,709 | S | 6/1993 | Walkley et al. |
| 5,335,952 | A | 8/1994 | Clapper |
| 5,382,063 | A | 1/1995 | Wesener et al. |
| 5,390,628 | A | 2/1995 | Vito |
| D366,709 | S | 1/1996 | Szmanski |
| 5,540,469 | A | 7/1996 | Albert |
| 5,540,470 | A | 7/1996 | Lu |
| 5,580,111 | A | 12/1996 | Bohn |
| D377,247 | S | 1/1997 | Albert |
| 5,661,873 | A | 9/1997 | Karet |
| 5,868,447 | A | 2/1999 | Clark et al. |
| D406,927 | S | 3/1999 | Feldmeier |
| 6,012,748 | A | 1/2000 | Franks |
| 6,032,995 | A | 3/2000 | Barbaro |
| 6,196,601 | B1 | 3/2001 | Juntunen, Jr. |
| 6,216,314 | B1 | 4/2001 | Dangerfield |
| 6,305,322 | B1 | 10/2001 | Patel |
| 6,439,627 | B1 | 8/2002 | Devane |
| D473,763 | S | 4/2003 | Jones |
| 6,618,898 | B2 | 9/2003 | Tingle |
| 7,077,172 | B2 * | 7/2006 | Perkitny et al. ..... 141/10 |
| 2004/0084914 | A1 | 5/2004 | Karimi et al. |
| 2004/0164568 | A1 | 8/2004 | Diehl |

FOREIGN PATENT DOCUMENTS

| | | |
|---|---|---|
| GB | 2 227 645 | 8/1990 |
| WO | WO93/20285 | 10/1993 |

* cited by examiner

WASTE COLLECTION DEVICE

This application is a continuation-in-part of prior U.S. patent application Ser. No. 10/811,103, filed Mar. 26, 2004 now U.S. Pat. No. 7,077,172, commonly owned and expressly incorporated herein by reference, which itself claims the benefit of U.S. Provisional Patent Application Nos. 60/458,594, filed Mar. 28, 2003, and 60/476,686, filed Jun. 6, 2003, both also expressly incorporated herein by reference. This application also claims the benefit of U.S. Provisional Patent Application No. 60/662,832, filed on Mar. 17, 2005, expressly incorporated herein by reference.

BACKGROUND

The present invention relates to a waste collection device. More particularly, the present invention relates to a motorized waste collection device that employs a liner bag, such as a disposable liner bag, to mechanically remove waste or debris (which can be liquid, solid or semi-solid) from a surface to be cleaned. The waste collection device and the liner bag find application in a variety of configurations and will be described with particular reference to one exemplary configuration. It is to be appreciated, however, that the invention may relate to other similar environments and applications.

A wide variety of types of waste collection devices are generally well known. One representative example of such a waste collection device is disclosed in U.S. Pat. No. 5,382,063 to Wesener et al. The '063 patent is directed to a waste product collection device for removing relatively small volumes of waste product from a surface. The '063 device includes a housing having an opening at one end and a handle mounted on a top surface thereof. To operate, a user places the opening of the device adjacent the material or waste to be collected and scoops the waste into the opening. A flexible lip is provided along the bottom of the opening to assist in the scooping of the waste. The device further includes a lid pivotally secured to the housing for covering the opening after the waste is collected therein. A disposable bag is disclosed for use with the device.

One drawback of the '063 device is that the scooping motion required to collect the waste can result in the waste being flung away from the device rather than into it. Further, the scooping motion may make it difficult for a user to force the waste into the opening. This is particularly evident when the device is used to pick-up waste that is semi-solid such as, for example, spilled yogurt. The scooping motion pushes the semi-solid waste around and does not generally facilitate waste removal.

While some known devices, such as the one illustrated in U.S. Pat. No. 4,078,838 to Nadratowski, are so designed as to pull a liner into a housing together with the debris picked up by the liner, these devices also have drawbacks. For example, the debris can fall out of the housing since the housing is held at a fairly steep angle in relation to the surface from which the debris is picked up. Also, the housing only presents a narrow opening adjacent the surface so that wider debris pieces or waste are difficult to pick up cleanly.

Accordingly, there is a need for a waste collection device that is easy to use and is able to remove waste even when in a semi-solid state. It is desirable for such a device to be easily usable with a liner so as to reduce the need for cleaning the device after each use. It is further desirable that the liner draw the waste into the device so as to reduce the mess on the surface being cleaned. Optionally, such a device can further include one or more of the following features:

ability to be handheld, operated by batteries, ability to fold-up for compact storage, include storage for additional liners, provide illumination and include a means for preventing removed waste from escaping the device.

SUMMARY

In accordance with one aspect, an improved waste collection device is provided. More particularly, in accordance with this aspect, the waste collection device includes a body having a housing defining an opening which allows an open end of an associated bag to be folded thereover. The housing receives a closed end of the associated bag therein. A spool is rotatably connected to the body and removably connected to the associated bag. A driving mechanism is connected to the spool for selectively rotating the spool such that the associated bag is wound on the spool thereby pulling the associated bag into the housing.

In accordance with another aspect, a waste collection device is provided that includes a body having a housing defining an opening which allows an open end of an associated bag to be folded thereover. The housing receives a closed end of the associated bag therein. A spool is rotatably connected to the body and removably connected to the associated bag. A motor is selectively connected to the spool for selectively rotating the spool such that the associated bag is wound on the spool thereby pulling the associated bag into the housing.

In accordance with still another aspect, a waste collection device includes a body including a U-shaped housing having an open end. A frame member is pivotally secured to the housing adjacent the open end. The frame member is movable toward an open position for defining an opening together with the U-shaped housing. A spool is rotatably connected to the body at a location spaced from the open end. A bag has a bag closed end adapted to be secured to the spool and a bag open end adapted to be passed through the housing open end and folded over the housing and the frame member. Rotation of the spool winds the bag thereon and pulls the bag open end into the housing open end.

BRIEF DESCRIPTION OF THE DRAWINGS

The invention may take physical form in various components and arrangements of components, and in various steps and arrangements of steps. The drawings are only for purposes of illustrating embodiments of the invention and are not to be construed as limiting the invention.

DETAILED DESCRIPTION

Figure 1:
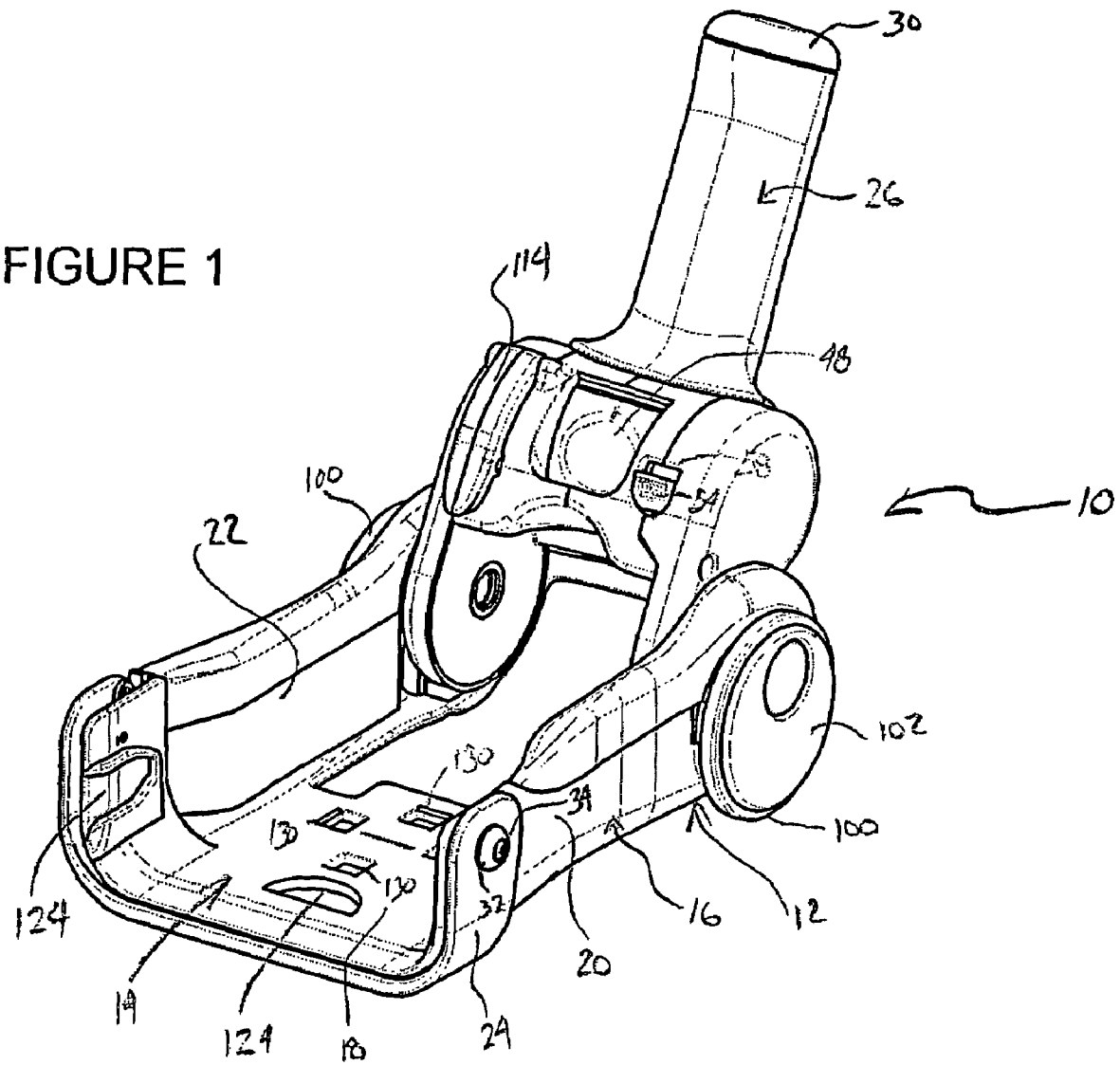
FIG. 1 is a front perspective view of a fold-up waste collection device according to one embodiment showing the device in a fully folded-open position.

Referring now to the drawings wherein the showings are for purposes of illustrating one or more embodiments only and not for purposes of limiting the same, FIG. 1 shows the waste collection device according to one embodiment and generally designated by reference numeral 10. In the illustrated embodiment of FIG. 1, the device 10 is a fold-up waste collection device and is shown in a fully unfolded position. The device includes a body having a handle 26 and a housing 12 defining an opening or open end 14 of the device 10. In the illustrated embodiment, the housing 12 is generally formed of a U-shaped or channel-shaped base portion 16 having a substantially flat lower wall 18 and a pair of spaced apart side walls 20,22 extending upward from the lower wall 18. The body of the device 10 also includes a frame member or frame 24 pivotally mounted adjacent the open end 14 of the housing 12. The frame member 24 is also U-shaped and, as will be described in more detail below, can, together with the housing 12, completely form the opening 14. In many respects, the device 10 is like and/or functions like the waste collection devices shown and described in FIGS. 19-45 of commonly owned, U.S. patent application Ser. No. 10/811,103, expressly incorporated herein by reference in its entirety.

Of course, the configuration of the housing 12 and handle 26 are not to be limited by the device shown and described herein and it is to be appreciated that the housing and handle could have alternate configurations that are to be considered within the scope of the present invention. For example, other configurations could include without limitation the housing 12 being cylindrical or varying in length, the handle 26 extending from another part of the housing or formed more integrally with the housing, the housing having an extra wide mouth opening that is relatively shorter in height than opening 14 of the illustrated embodiment, etc. However, in any configuration, it can be advantageous to have a wide and/or flat lower wall for purposes of removing waste and, in particular, semi-solid waste.

Figure 2:
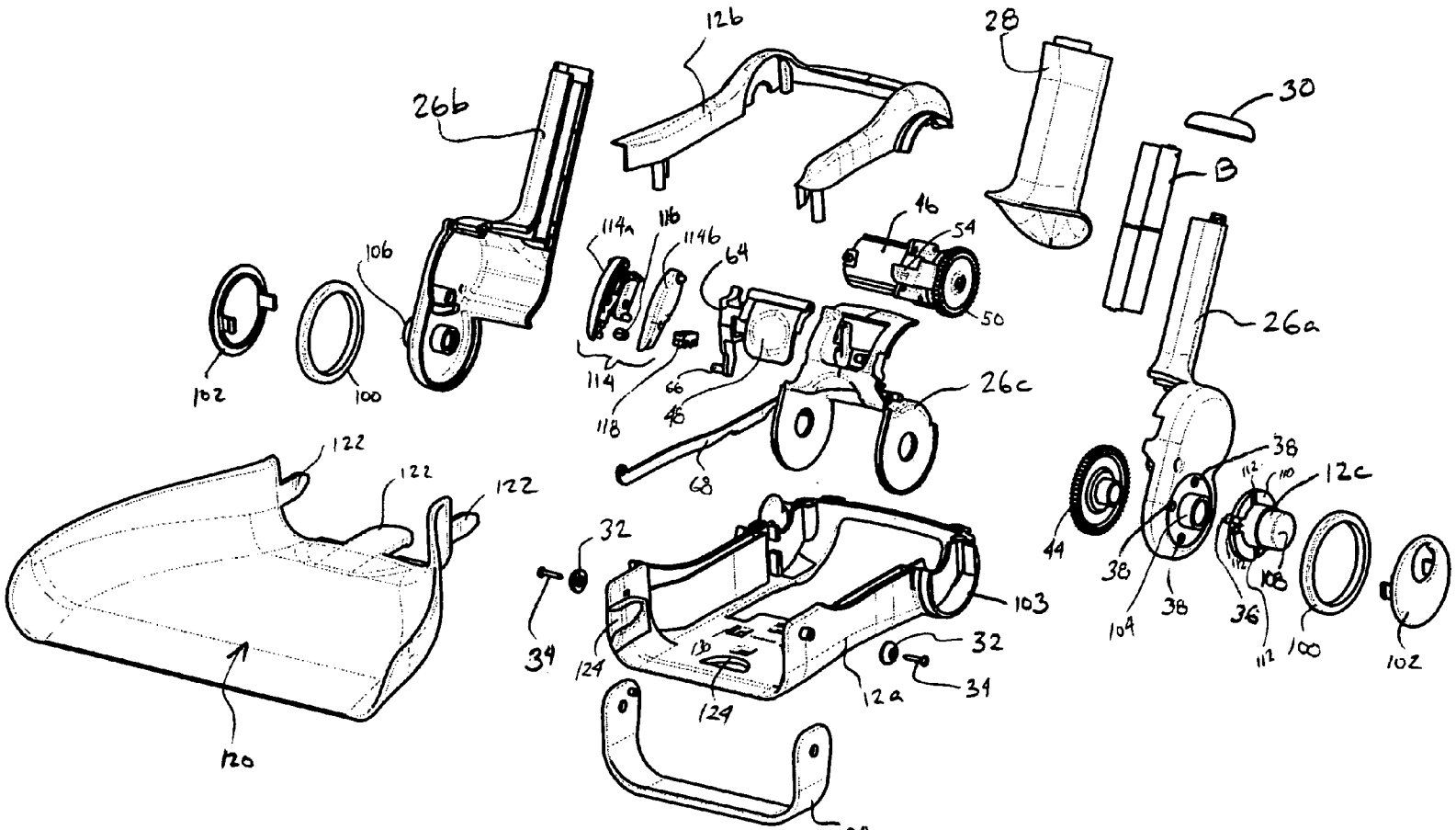
FIG. 2 is an exploded perspective view of the waste collection device of FIG. 1.

With additional reference to FIG. 2, the housing 12 can be formed of a lower member 12*a* and an upper member 12*b* for ease of assembly and molding. The handle 26 can be formed of a first side member 26*a*, a second side member 26*b*, a lower or inner member 26*c* and a gripping portion 28. The gripping portion 28 can be contoured and/or formed of a rubberized material so that a user is better able to hold and operate the device 10. As shown in the illustrated embodiment, the frame member 24 is pivotally connected to housing 12 by suitable bearing members 32 and pivot pins 34. A battery storage compartment is optionally formed in the handle 26 between the handle members 26*a*,26*b* and adjacent the gripping portion 26*a*. The battery storage compartment can be configured to operatively receive one or more batteries B such as conventional AA alkaline batteries, or the like. The batteries B received in the handle 26 can be accessible through a cover or door 30 provided on a distal end of the handle 26. Although conventional batteries are shown and described as the power source for the device 10, it is to be appreciated that any other power source could be used in place of the batteries, such as for example conventional AC power and/or rechargeable batteries.

In FIG. 1, the device 10 is shown in the fully unfolded position wherein the device is able to remove waste as will be described in more detail below. In this, the handle 26 is pivoted relative to the base portion 16 so that the handle is angled in relation to a plane of the housing 12 which allows the handle to be grasped by a user. For example, the handle can be oriented normal or at an obtuse angle relative to the plane of the lower wall 18. With additional reference to FIGS. 3 and 4, the handle 26 can be rotated so as to lie adjacent the lower wall 18 and into the base portion 16. In this way, the device 10 is in a fully folded-up or folded-down position (FIG. 3) for compact storage. Also, the handle can be moved to an intermediate position (FIG. 4) wherein the handle is positioned between the fully unfolded position and the fully folded-up position, as may be advantageous when carrying or moving the device 10 while waste is carried within the base portion 16.

Figure 3:
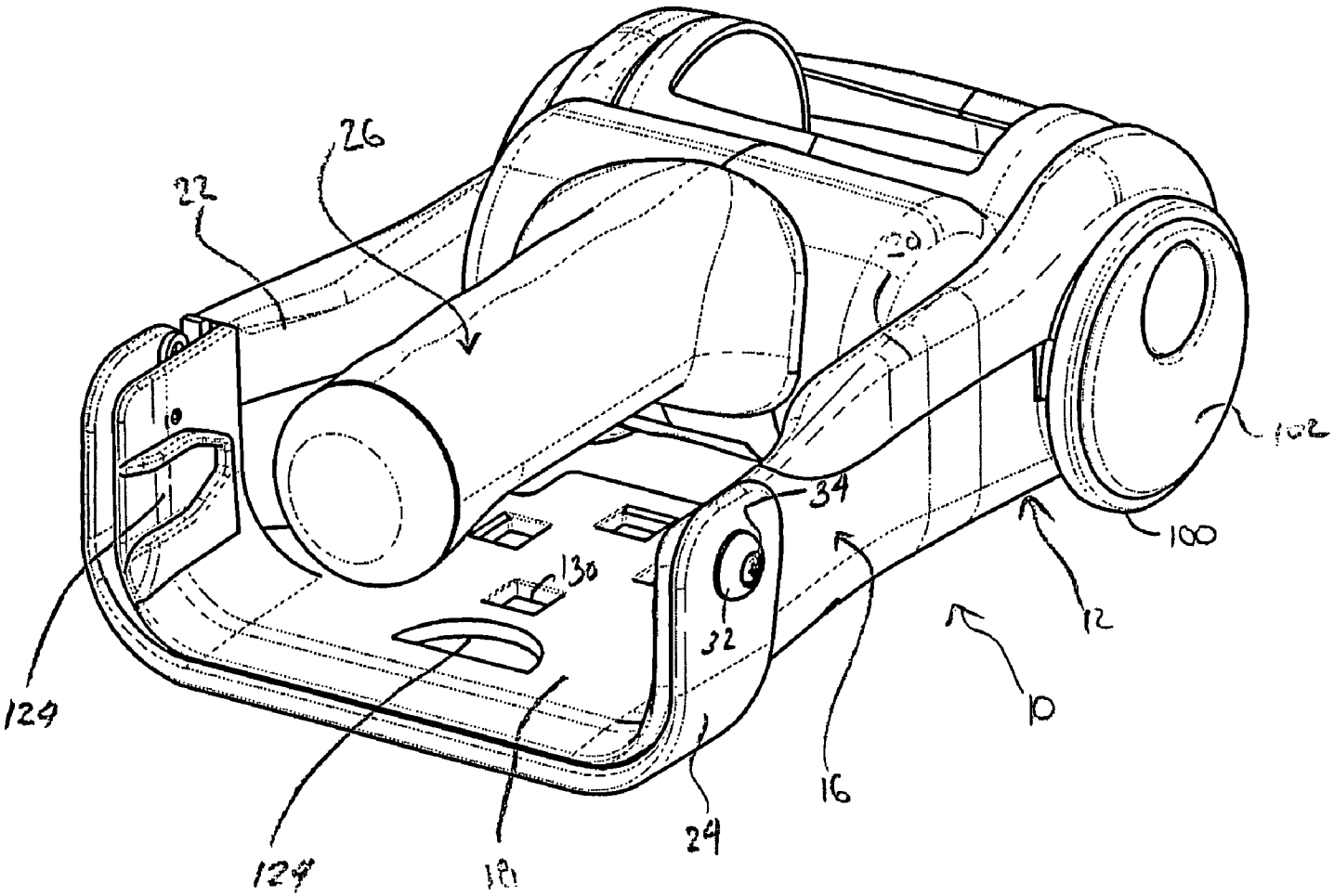
FIG. 3 is an enlarged front perspective of the waste collection device of FIG. 1 showing the device in a fully folded-closed position.

The three positions, including the fully folded open position of FIG. 1, the fully closed position of FIG. 2 and the intermediate position of FIG. 3, can be preselected positions wherein the handle is resiliently held in position. In the illustrated embodiment, with specific reference to FIG. 2, the handle 26 includes a button member 108 mounted on protuberance 104 of the handle member 26*a*. The button member 108 includes tabs 36 that are received in recesses 38 so that the button member 108 moves with the handle 26 relative to the housing 12. The button member 108 also includes a flange 110 that is disposed between the handle member 26*a* and an inside wall portion of the lower housing member 12*a*. Although not shown, a spring can be mounted between the handle member 26*a* and the button member 108 to urge the button member toward the housing member 12*a*. In one embodiment, the flange 110 includes grooves 112 that selectively receive protrusions or tabs (not shown) integrally formed on the housing member 12*a*, wherein each tab or set of tabs correspond to one of the preselected positions. Of course, as will be appreciated by those skilled in the art, any number of positions can be employed in the device 10, including any number of intermediate positions, and other biasing mechanisms can be used for maintaining the handle in one of the preselected positions. As will further be appreciated by those skilled in the art, other means or arrangements can be employed for holding the handle in a preselected position.

Figure 15:
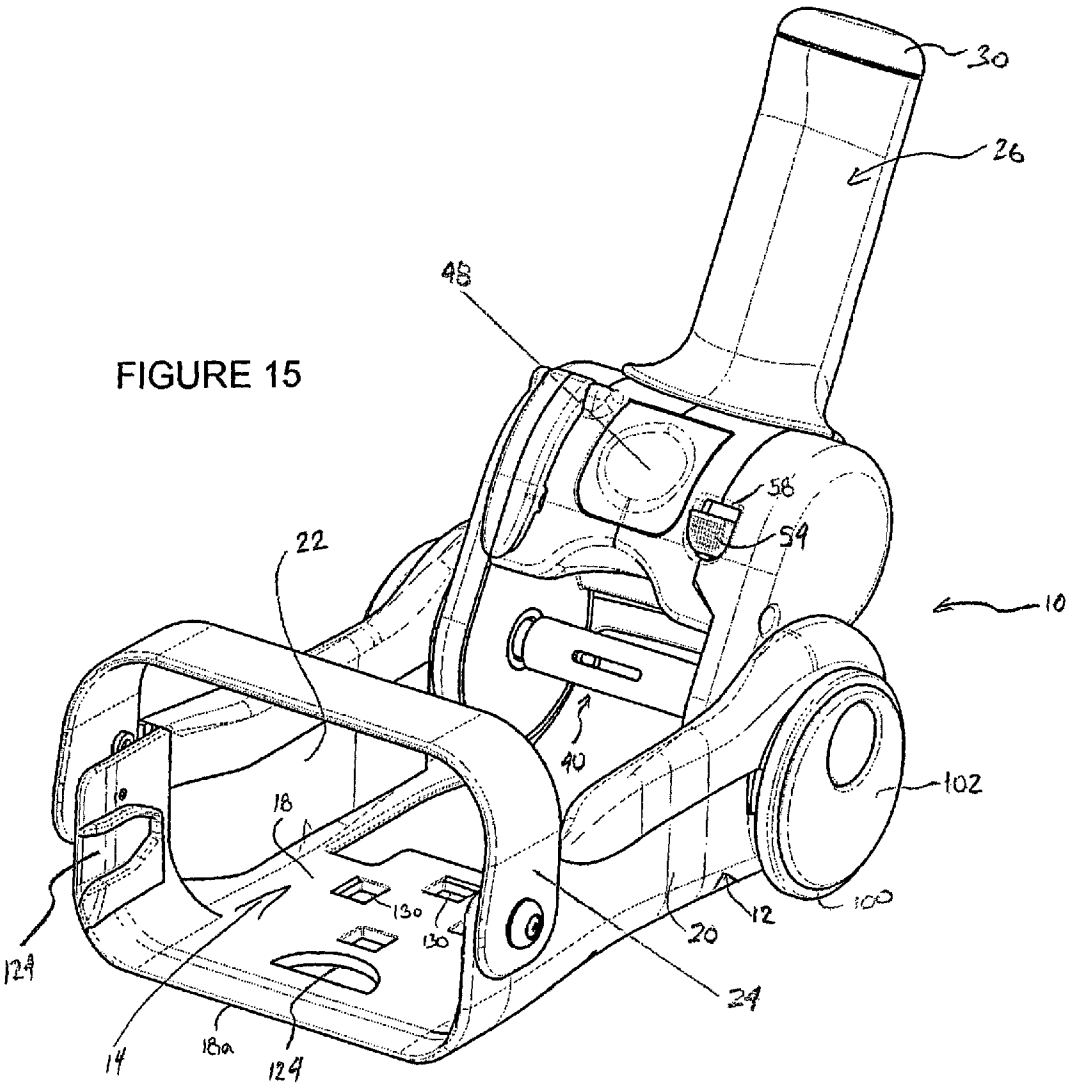
FIG. 15 is an enlarged front perspective view of the waste collection device of FIG. 1 shown with the frame member in a fully open position and ready to receive a liner thereon.

For installing a liner or liner bag within the device 10, such as those described in the above-referenced '103 application, the frame member 24 is pivotal between a fully closed position (shown in FIG. 1) and a fully open position (shown in FIG. 15). In the fully closed position of FIG. 1, the frame member 24 pivots or rests around the U-shaped base portion 16. When opened to the fully open position of FIG. 15, the frame member 24 and the U-shaped base portion 16 together fully define the opening 14. With the frame member 24 in the fully open position and the opening 14 fully defined, a liner can be secured to the device 10 as will be described in more detail below. However, it is to be appreciated by those skilled in the art that the device can also operate without the frame member 24 or with other alternate designs, types or shapes of frame members.

Figure 5:
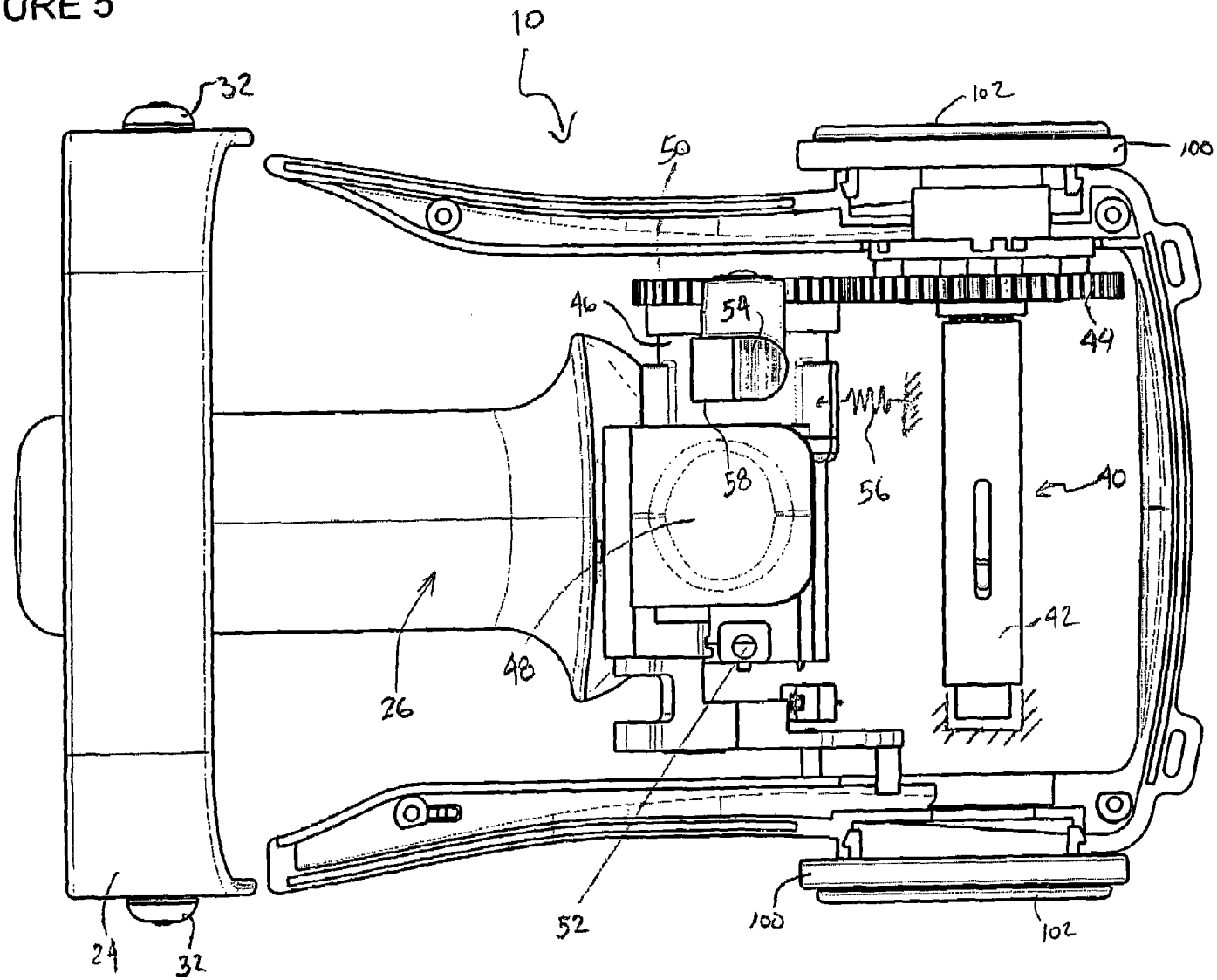
FIG. 5 is a bottom plan view of the waste collection device of FIG. 3 shown with another portion of the housing removed.

With reference to FIG. 5, the device 10 includes a pulling mechanism having a spool assembly or spool 40 rotatably connected to the housing 12. As used herein, mechanism refers to an arrangement of machine parts or a system of parts that interact or operate like those of a machine. The spool 40 is adapted to be removably connected to a liner to selectively pull the liner into the device 10 for purposes of picking up waste or debris as will be described in more detail below. The spool 40 includes a means for releasably connecting a liner thereto, an outer barrel member 42 for receiving the liner as it is wound about the spool and a means for powered rotation of the spool. In the illustrated embodiment, the means for powered rotation of the spool 40 is a spool gear 44 connected to the outer barrel member 42 as will be described in more detail below. In alternate configurations, the means for powered rotation could be a cylindrical surface adapted for frictional engagement by a power source, a sprocket adapted to be chain driven, etc.

With continued reference to FIG. 5, the handle 26 includes a driving mechanism having a motor 46 (shown as a combined motor and gear train), such as a conventional battery-powered electric motor, for providing powered rotation to the spool 40. The motor 46 can be selectively electrically connected to the batteries B (FIG. 2) for providing power thereto by actuation of a switch or actuating member 48 located on the handle 26. Thus, while the actuating member 48 is depressed, power can be allowed to flow to the motor 46 and, when the driving mechanism is connected to the spool 40 to rotate the spool, a liner connected to the spool will be wound thereon which pulls the liner into the opening 14 of the device 10. When the actuating member 48 is released, power from batteries is interrupted and prevented from reaching the motor 46. In one embodiment, a switch (not shown) is employed to disable actuation of the motor 46 when the handle 26 is in the fully closed position or in any position other than the fully open position. Operation of the actuating member 48 of the illustrated embodiment is further described below.

The driving mechanism further includes a transmission assembly or a means for selectively connecting output of the motor 46 to the spool 40 so that the spool is rotated in a first direction when the motor 46 is actuated. More particularly, the motor 46 is selectively mechanically connected to the spool 40 for powered rotation thereof. When mechanically connected, the motor 46 drives a spur gear 50. The gear 50 has teeth that are selectively engaged with teeth of the spool gear 44. The motor 46 and gear 50 are together selectively movable between an engaged position, wherein teeth of the gear 50 mesh with teeth of the spool gear 44, and a disengaged position, wherein teeth of the gear 50 are disengaged from teeth of the spool gear 44. When the spool gear 44 is engaged to the gear 50, rotation of gear 50 by the motor 46 causes the spool 40 to rotate in the first direction. This, in turn, causes the liner, when connected to the spool 40, to rotate or be wound about the outer barrel member 42 of the spool and be pulled into the opening 14. Winding of the liner about the spool 40 is used to remove waste from the surface or ground being cleaned, as will be described below.

Figure 6:
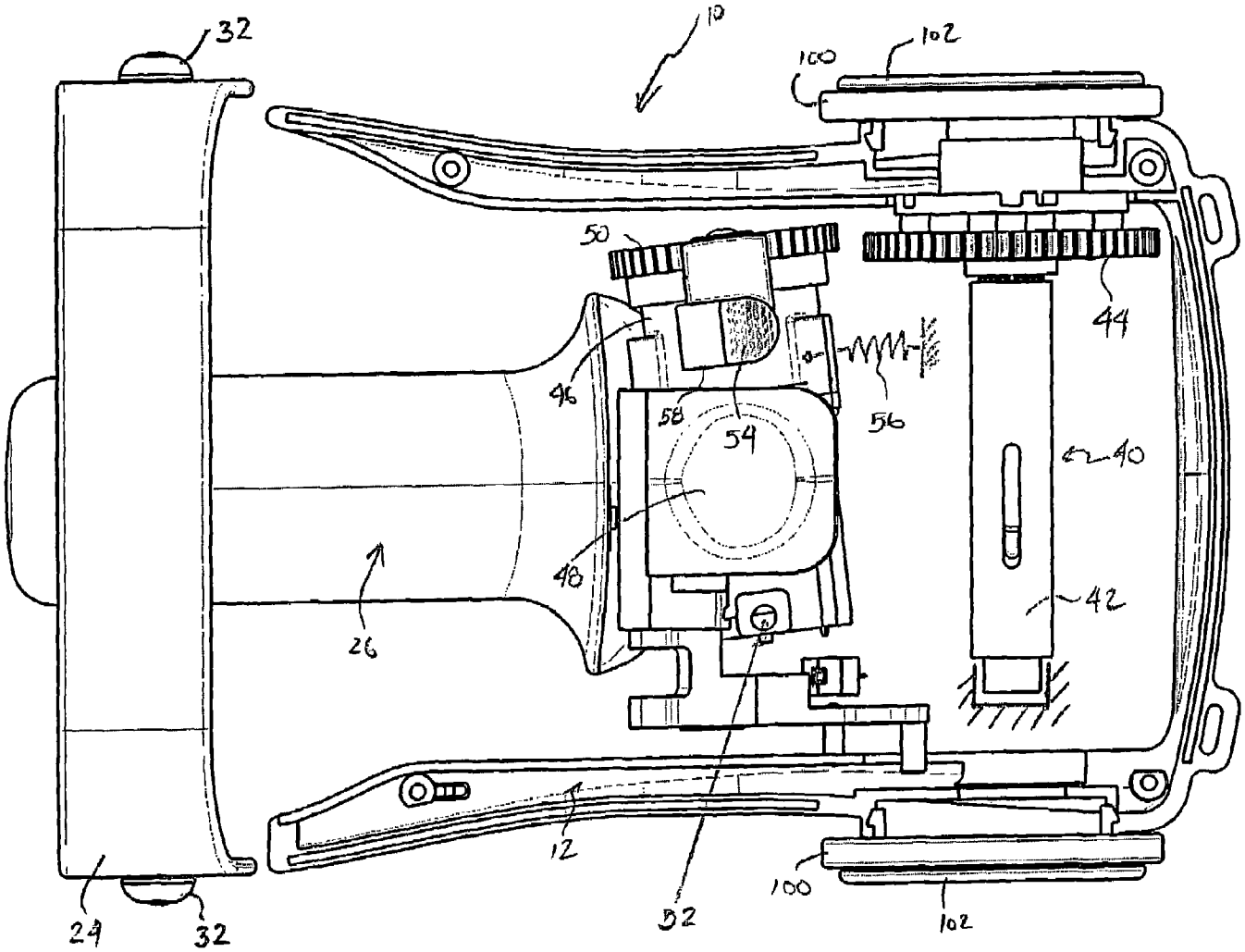
FIG. 6 is a bottom plan view of the waste collection device of FIG. 5 showing a motor gear disengaged from a spool gear.

With additional reference to FIG. 6, the means for selectively connecting output of the motor 46 to the spool 40 in the illustrated embodiment includes a means for disengaging the gear 50 from the spool gear 44 to allow manual rotation of the spool in a second, opposite direction. The means for disengaging gear 50 includes a motor and gear mounting arrangement wherein the motor 46 and gear 50 are pivotally mounted in the housing 12 by pivot pin 52 and a disengaging knob 54 for manually moving the motor 46 and gear 50 from the engaged position (shown in FIG. 5) to the disengaged position (shown in FIG. 6). As illustrated, the gear 50 is disengaged from the spool gear 44 when the motor 46 and gear 50 are in the disengaged position. More particularly, when a force is applied to the knob 54, the motor 46 is pivotally moved thereby moving gear 50 from the engaged to the disengaged position against the force of a biasing mechanism or means, such as spring 56. Thus, the force applied to the knob 54 should be large enough to overcome the resistance created by the spring 56. When force is no longer applied, spring 56 urges the motor 46 and gear 50 connected thereto back to the normal, engaged position of FIG. 5. As illustrated, the knob 54 can be disposed in a track or slot 58 of the housing 12 for guided movement thereof.

Figure 7:
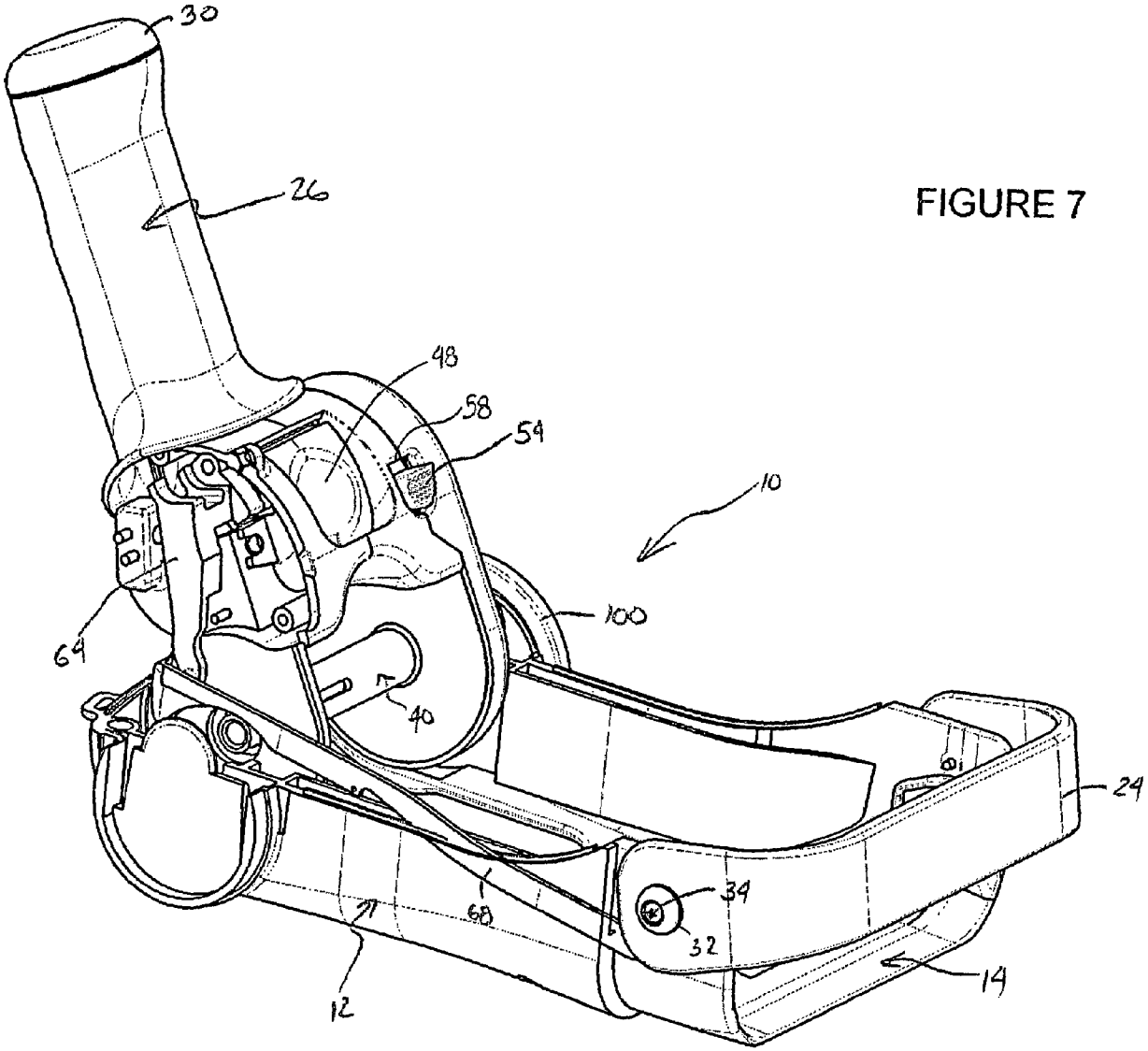
FIG. 7 is an enlarged side perspective view of the waste collection device of FIG. 1 shown with a portion of the housing removed and an actuator member partially depressed to mechanically move a frame member toward a closed position.
Figure 8:
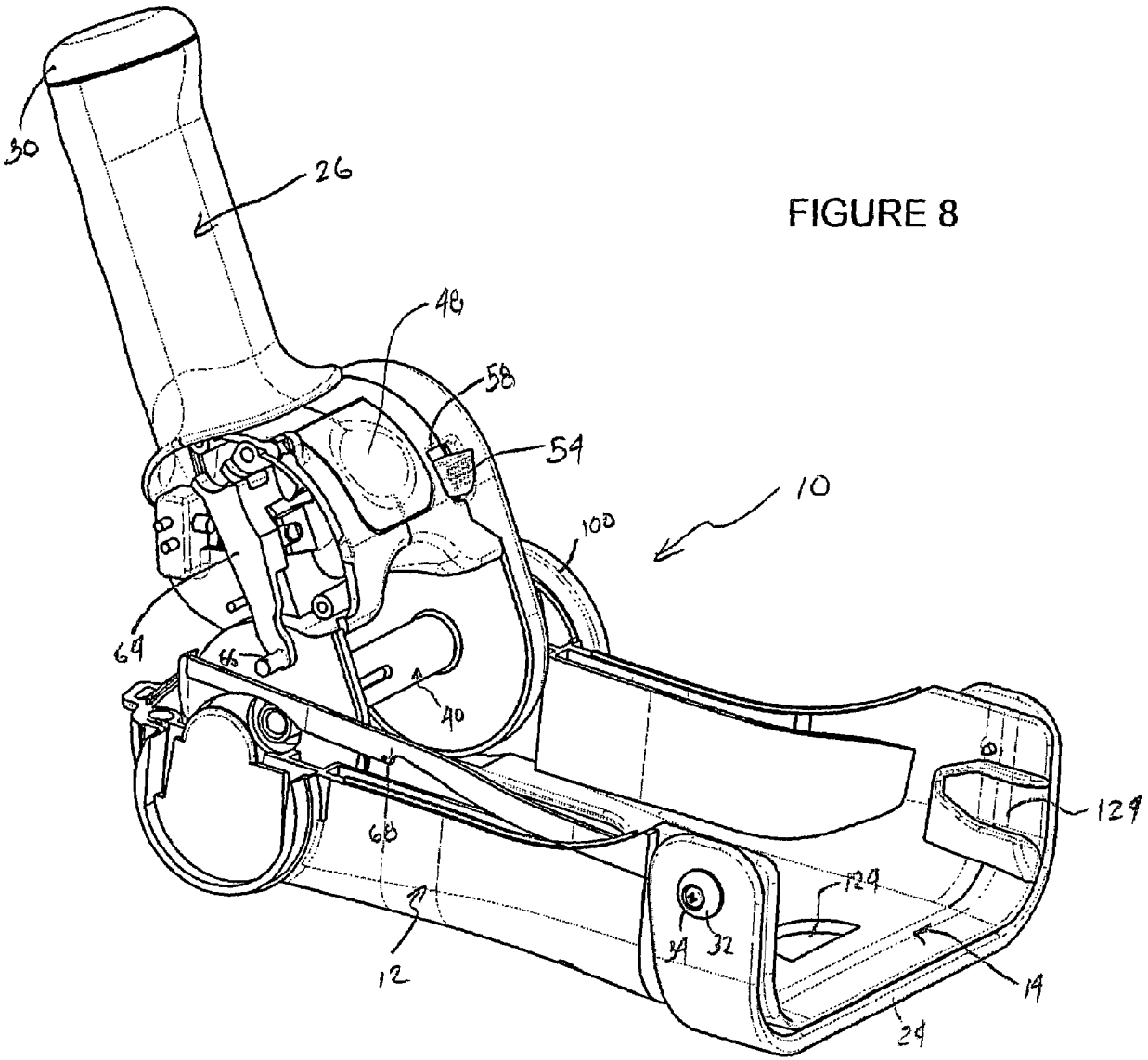
FIG. 8 is a side perspective view of the waste collection device of FIG. 7 shown with the frame member in a fully closed position.
Figure 9:
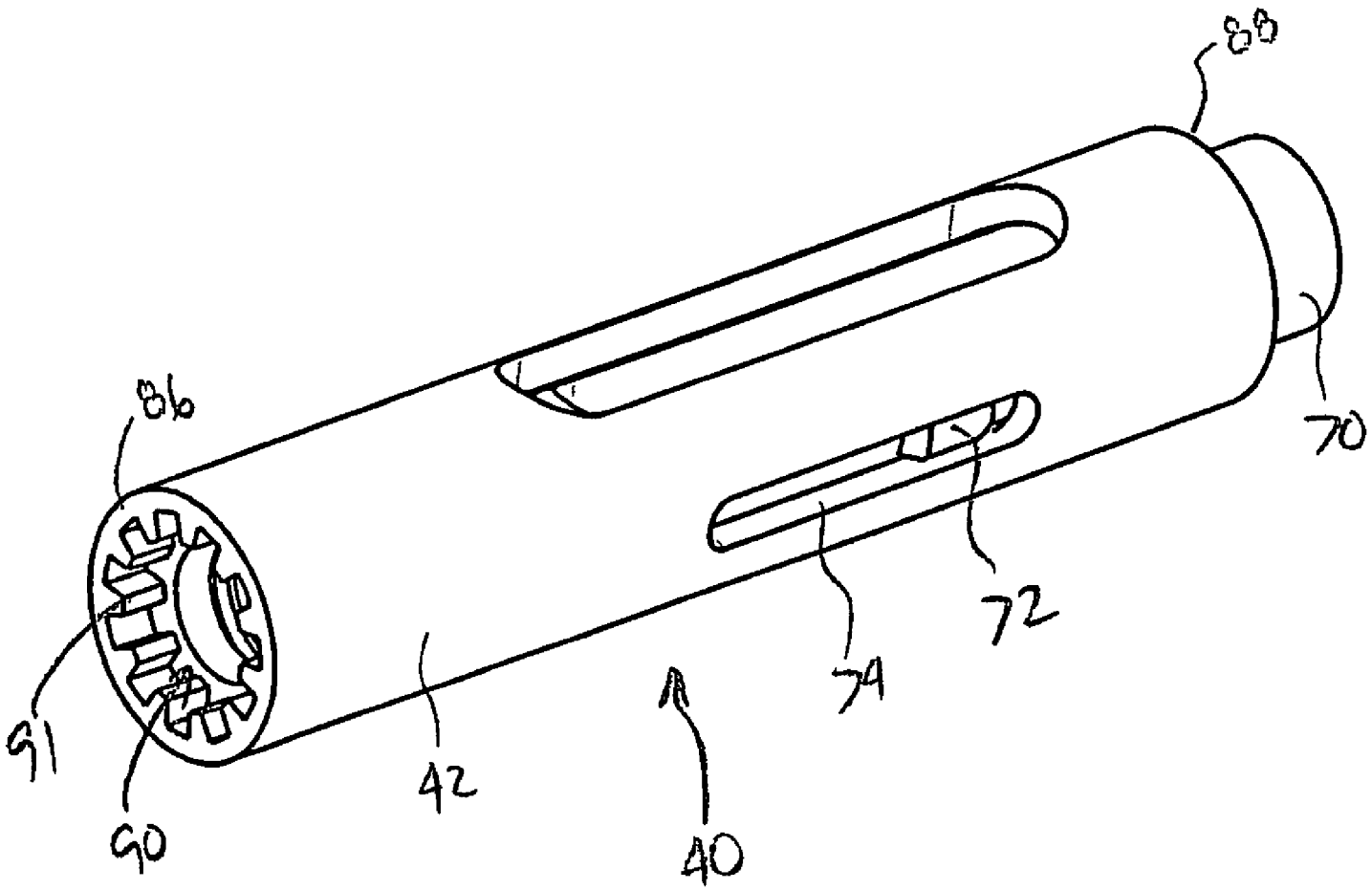
FIG. 9 is a perspective view of a spool assembly for use in the waste collection device of FIG. 1.
Figure 10:
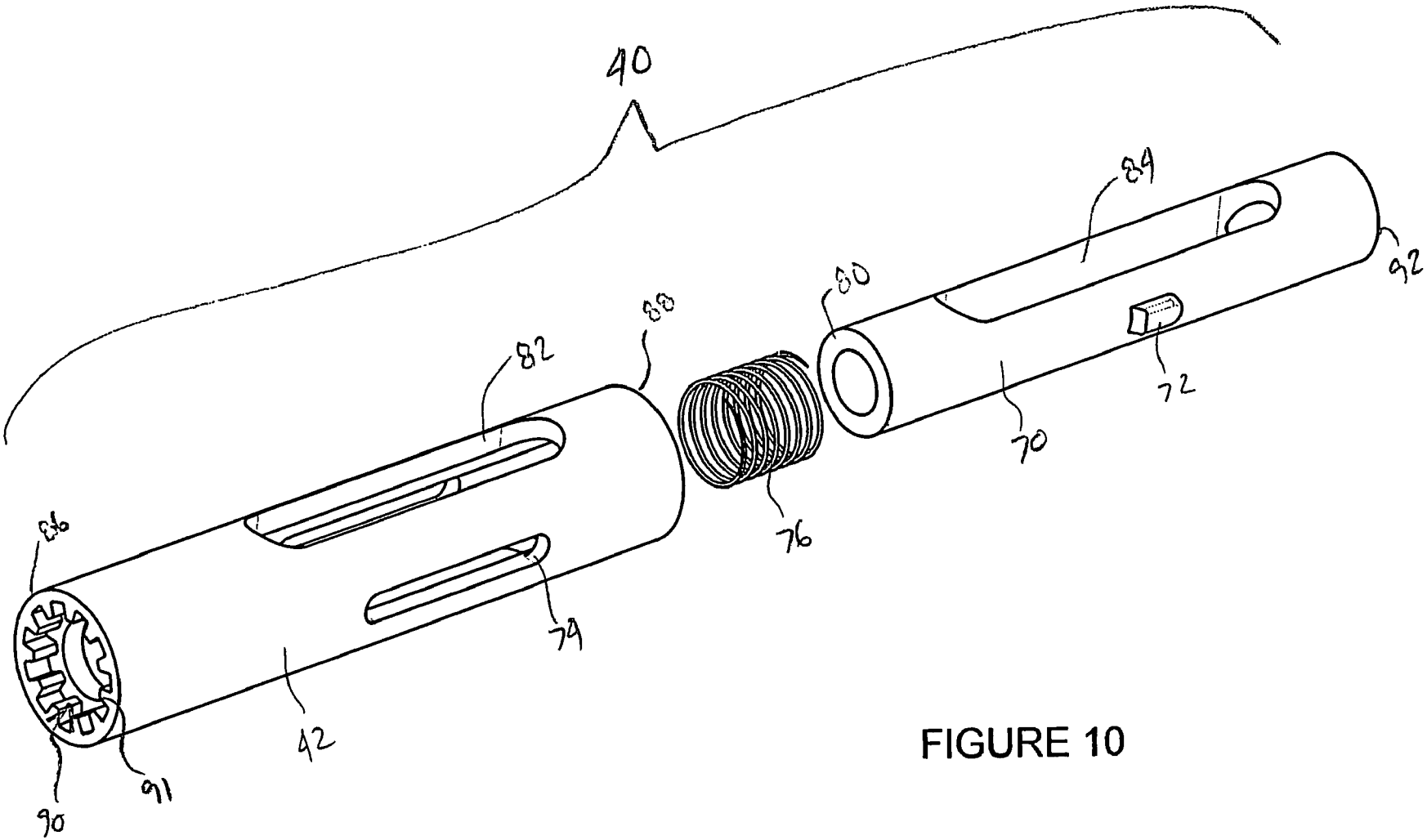
FIG. 10 is an exploded perspective view of the spool assembly of FIG. 9.
Figure 11:
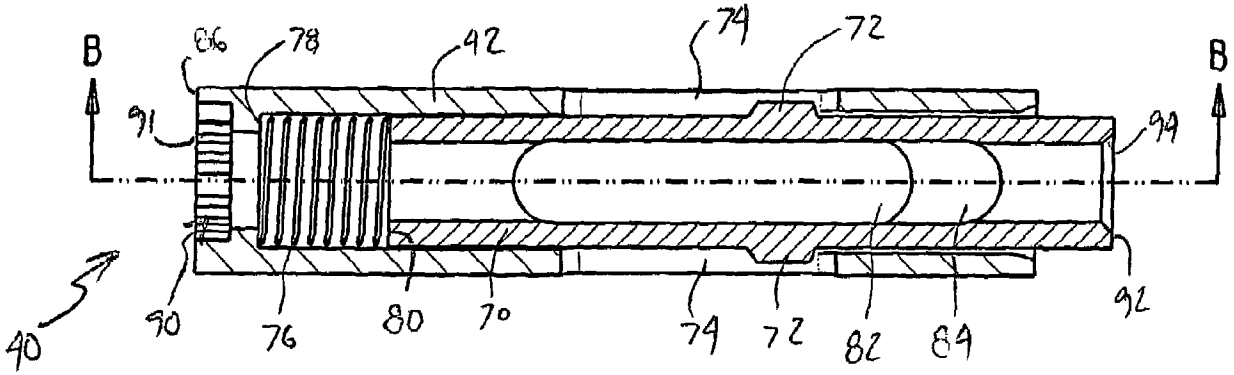
FIG. 11 is a cross-sectional view of the spool assembly of FIG. 9.
Figure 12:
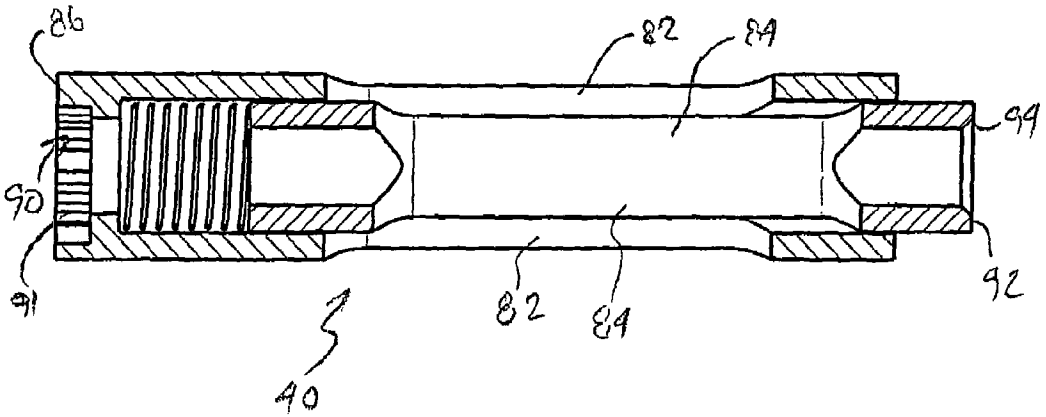
FIG. 12 is a cross-sectional view of the spool assembly taken along the line B-B of FIG. 11.

With additional reference to FIGS. 7 and 8, the actuator member 48 serves to mechanically operate the frame member 24 in addition to selectively connecting (electrically) the motor 46 to the batteries B for providing power thereto. In the illustrated embodiment, the actuator member 48 includes an arm or lever 64 having a protruding portion 66. The arm 64 moves with the actuating member 48 upon depression thereof, which causes protruding portion 66 to engage and move lever 68. In one embodiment, the protruding portion 66 is received in a basket portion (not shown) of the lever 68 so that, upon movement of the actuating member 48, the protruding portion 66 forcibly moves the lever 68. Lever 68 is connected distally to the frame member 24 for operation thereof.

More specifically, the lever 68 is connected to the frame member 24 at a location offset relative to an axis defined through the pivot pins 34. Thus, when the lever 68 is moved, i.e., pulled, by the arm 64 and its protruding portion 66, the frame member 24 is forced to pivot about the pivot pins 34 by the lever 68. Relative depression of the actuator member 48 corresponds to the degree of movement of the frame member 24 from the fully open position (see FIG. 15) toward the fully closed position (see FIG. 8). Full depression of the actuator member 48 need not move the frame member 24 to its fully closed position, but can move the frame member to an intermediate position between the fully open position and the fully closed position (such as the position shown in FIG. 7). In one embodiment, full depression of the actuator member 48 causes the frame member 24 to move adjacent to the fully closed position. Although not illustrated, the actuator member 48 is spring biased (by a spring between the lever 68 and the housing 12, for example) toward a normal, non-depressed position so that when a depression force is no longer applied to actuator member 48, the lever 68 is generally allowed to return to its starting position which also moves the frame member 24 back toward its fully open position.

In addition to movement caused by the actuator member 48 via the arm 64 and the lever 68, the frame member 24 is also manually movable between the fully open position (shown in FIG. 15) and the fully closed position (shown in FIG. 8). In the illustrated embodiment, the frame member 24 is only movable by the actuator member 24 between the fully open position and the intermediate position of FIG. 7, but can be manually moved to or from the fully open position. For operation of the device 10, the frame member 24 is initially moved to its fully open position. For storage or immediately after waste removal, the frame member 24 could be moved to its fully closed position. When the frame member 24 is in the fully closed position shown in FIG. 8, the lever 68 is moved apart from the arm 64 and the protruding portion 66 such that actuation or depression of the actuating member 48 no longer operates the frame member 24 via the lever 68. Specifically, depression of the actuating member 48 still causes the arm 64 and the protruding portion 66 to move therewith, but the protruding portion 66, being spaced apart from the lever 68, does not engage the lever and therefore is not able to move the frame member 24 until the frame member is returned to or toward its fully open position.

In one embodiment, the actuating member or button 48 is a two-function actuating member. More specifically, upon an initial depression of the actuating member 48, power is connected between the batteries B and the motor 46. Initial depression of the actuating member 48 has no effect on the lever 68 and therefore no effect on the frame member 24, i.e., initial depression of the member 48 does not move the frame member 24. Further depression of the actuating member 48 beyond initial depression continues to connect power from the batteries B to the motor 46, but has the further effect of operating the lever 68 to selectively move the frame member 24 as described above. The degree to which the actuating member 48 is further depressed directly corresponds to the degree of movement of the frame member 24 from the fully open position toward the closed position. As already mentioned, if the frame member 24 is manually moved to the fully closed position, depression of the actuating member 48 has no effect on the frame member 24. The spring, or other biasing means or device, for returning the actuating member 48 to its neutral position, i.e., the position in which no depression or actuating force is applied, enables the actuating member to return to its initial position wherein the frame member 24 is returned to the fully open position (provided it was not manually positioned in the fully closed position) and disconnects power between the batteries B and the motor 46.

With reference to FIGS. 9-12, the spool 40 of the illustrated embodiment includes an outer barrel member 42 and an inner barrel member 70 telescopingly received within the outer barrel member 42. The inner barrel member 70 includes a pair of diametrically opposed guide tabs 72 that are received in corresponding slots 74 of the outer barrel member 42 for guiding telescopic movement between the inner member 70 and the outer barrel member 42. The inner barrel 70 can be formed of a slightly resilient material, such as a suitable thermoplastic, to permit ease in initially installing the tabs 72 into the slots 74 in outer barrel member 42. The tabs 72 prevent the inner barrel 70 from rotating relative to the outer barrel member 42. A spring 76 is disposed between an innermost end 78 of the outer barrel member 42 and inner member end 80 which is received in the outer member 42. The spring 76 urges the inner member 70 to protrude out of the outer barrel member 42 toward an elongated position.

Optionally, diametrically opposed liner or bag slots 82 are defined in the outer barrel member 42 and corresponding liner or bag slots 84 are defined in the inner member 70. When the inner member 70 is received within the outer member 42, the slots 82, 84, or other apertures, are in at least partial registry with one another such that the end of a liner could be threaded through the spool 40 and tied off. Of course, the slots 82, 84 need not be provided in the spool and/or other means can be provided for attaching the end of a liner to the spool 40. For example, a liner or a roll of liners could be adhered to the spool or merely wound tightly around the spool 40.

The outer barrel member 42 further includes a first closed end 86, and a second, opposite, receiving or open end 88 in which the inner member 70 is received. The first end 86 includes a socket 90 having gear teeth 91 directed radially inwardly. Teeth 91 are selectively engageable with the spool gear 44 as will be described in more detail below. Inner member end 92, opposite end 80 received in the outer barrel member 42, defines an opening 94 which can be used to removably mount or secure the spool 40 to the housing 12, as will be described in more detail below. Of course, as should be appreciated and understood by those skilled in the art, other spools can be employed with the device 10 and the device 10 need not be limited to the spool 40 shown in the illustrated embodiment and described herein. For example, in one embodiment, the spool 40 can be modified such that the socket 90 is formed on the inner member 70 and end 86 can be received in a recess of the device 10 or have an opening for receiving a raised portion of the device 10.

Figure 13:
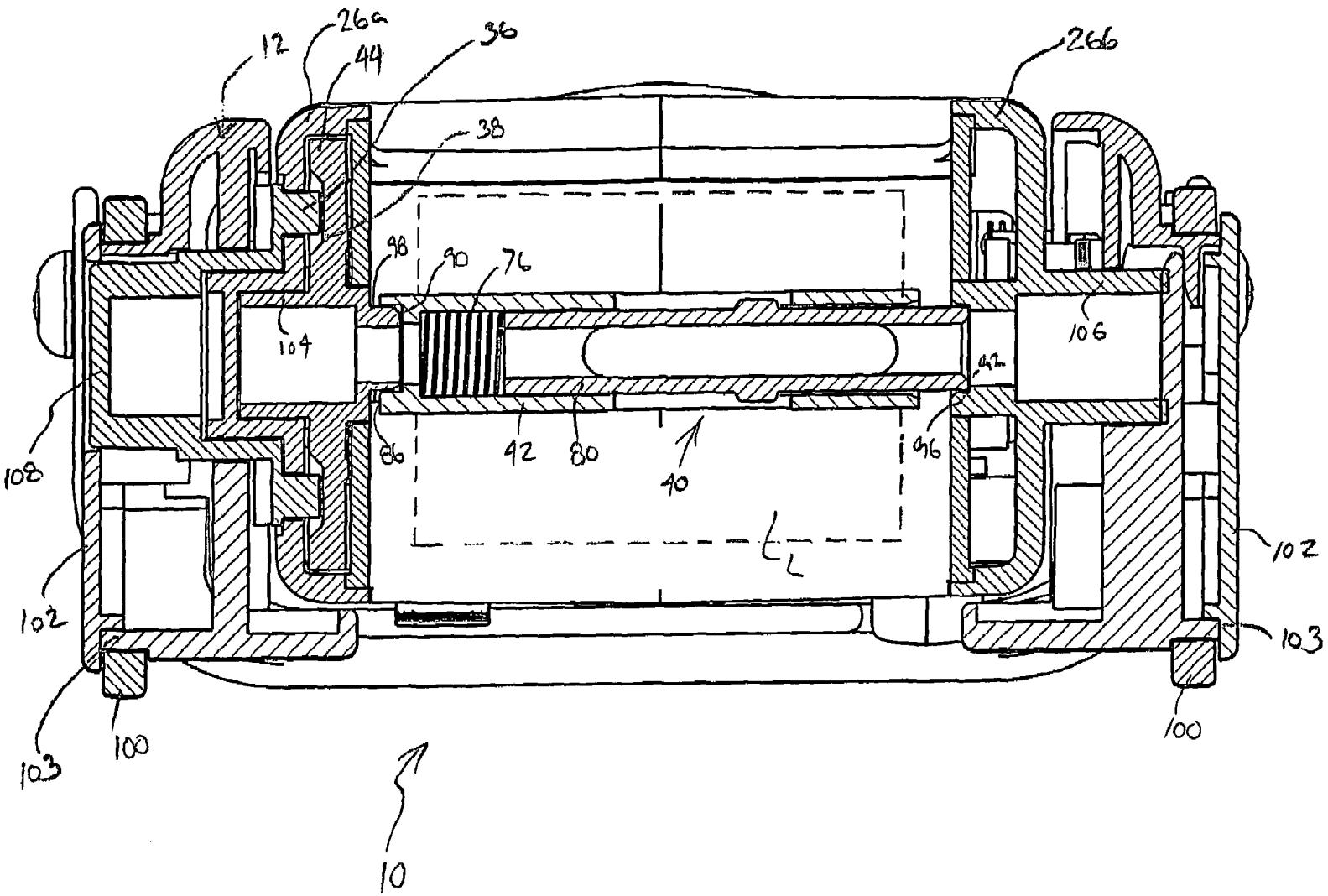
FIG. 13 is an enlarged cross-sectional view of the waste collection device of FIG. 3 showing the spool assembly operatively mounted within the housing of the device.

With additional reference to FIG. 13, the spool 40 is shown installed in the housing 12. To install the spool 40, one end thereof (gear end 86 or inner member end 92) is first installed and then the other end 86 or 92 is subsequently installed. For example, end 92 can be first installed by inserting it in a counterbored recess 96 defined in the handle member 26*a*. Alternatively, a protuberance or boss could be provided on the housing for receipt within the opening 94 of the inner member 80. In any case, the spool 40 can then be compacted by forcibly moving the outer barrel member 42 toward the end 92 against the urging of the spring 76 so that the geared socket 90 can be aligned with a corresponding gear 98 integrally formed with the spool gear 44. Once aligned, the outer barrel member 42 can be allowed to expand apart slightly relative to the inner member 80 and the gear teeth 91 can mesh with the gear 98 of the spool gear 44. As indicated in dashed lines, a roll of liners L can be provided on the spool 40. Alternatively, an individual liner can be used with the spool. For example, the closed end of the liner could be passed through the aligned slots 82, 84 and tied off such that rotation of the spool would cause the individually attached liner to be wound thereabout.

As shown, the device 10 can additionally include wheels 100 for facilitating movement of the device upon a supporting surface, particularly when removing waste from said supporting surface. In the illustrated embodiment, the wheels 100 are freely rotatable relative to the housing 12 on both sides thereof adjacent a rear end of the housing. Wheel caps 102 can be added to the housing 12 to improve the appearance of the device 10. Specifically, the wheels 100 are mounted for rotation on stationary sections 103 (FIG. 2) of the housing member 12*a*. Of course, other wheel configurations are possible and all such wheel configurations are to be considered within the scope of the present invention. Protuberances 104 and 106 can be provided on the handle members 26*a*, 26*b* to facilitate pivotal movement of the handle 26 relative to the housing 12.

Figure 14:
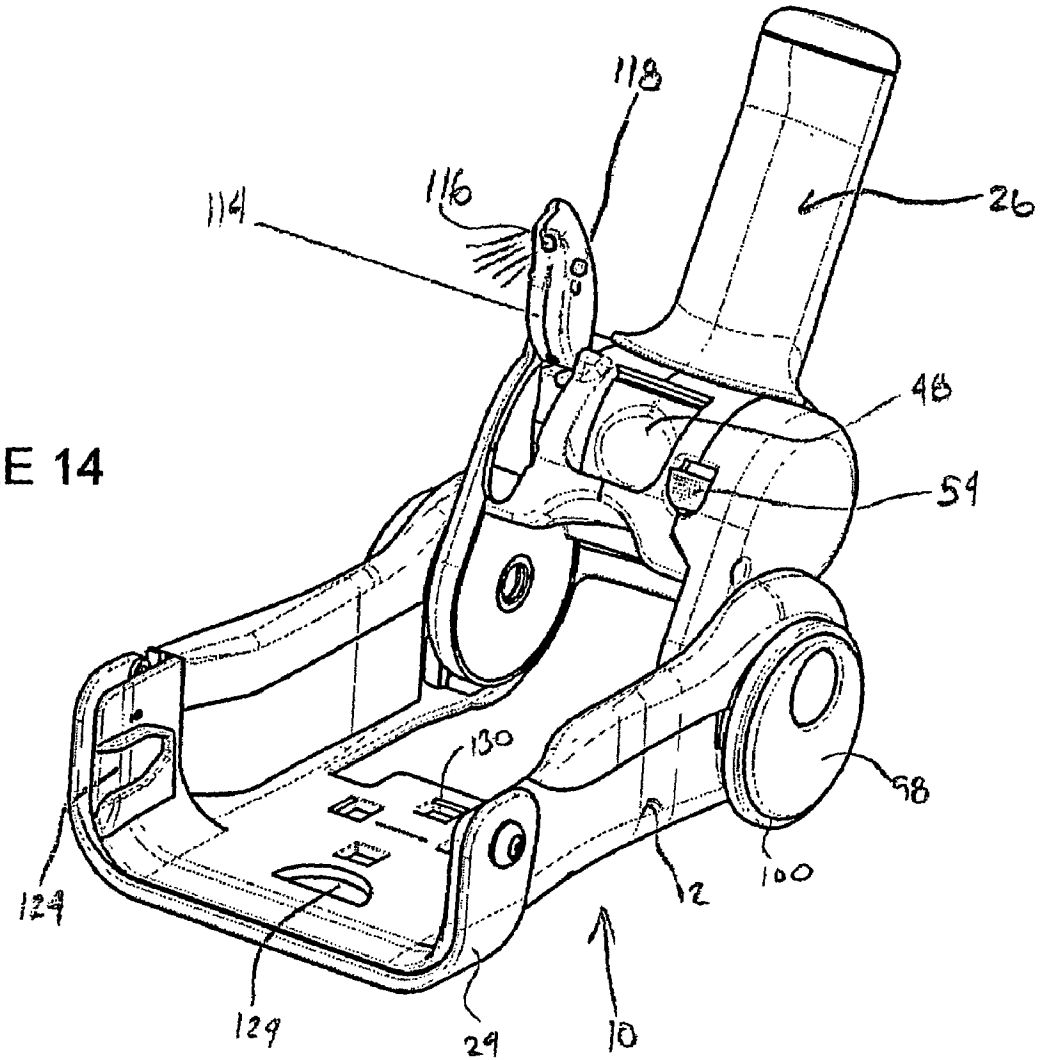
FIG. 14 is a front perspective view of the waste collection device of FIG. 1 showing a light housing in an open position to provide illumination for the device.

The device 10 can additionally include a lighting means or device. For example with reference to FIG. 14, a movable light housing 114 can be provided on the housing 12. The light housing 114 could be movable from a closed position (shown in FIG. 1) to an open position (shown in FIG. 14)

wherein a light source 116 directs light or illumination toward a front end of the device 10. The light housing 114 can include a switch 118 that is urged to an on position by a spring or other biasing mechanism (not shown), causing a light source 116 to be activated when the light housing 114 is in the open position. When the light housing 114 is moved to its closed position the light is shut off. With reference to FIG. 2, the light housing 114 can be formed of a pair of light housing halves 114*a*, 114*b*. Power for the light source 116 can be provided by the batteries B. In an alternate embodiment, such power can be selectively controlled by the actuating member 48, in the manner in which power is controlled to the motor 46, instead of or in addition to the switch 118.

Still another feature can include a front end attachment 120 which selectively connects to a front end of the device 10 for facilitating scooping of waste. The attachment 120 can include resilient tabs 122 that are removably received within slots or apertures 124 defined toward the front end of the housing 12, and specifically the lower housing member 12*a*. The attachment 120 can include an extra wide mouth portion at a front end thereof. Of course, other attachments could be used and all types of other known attachments are to be considered as contemplated for use with the device 10. Yet another feature is the provision of one or more apertures 130 defined in the housing 12 for enabling the device 10 to be connected to another device, such as, for example, a retractable dog leash. To the extent possible, other features discussed in reference to one or more of the embodiments of the above-referenced '103 application can also be optionally included on the device 10.

To load a liner, such as one of the liners described in the above-referenced '103 application, into the waste collection device 10, the handle 26 and the frame member 24 are moved from their stowed positions, shown in FIG. 3, to their open positions, shown in FIG. 15. More particularly, with specific reference to FIG. 15, the handle 26 is moved to the illustrated fully unfolded position and, likewise, the frame member 24 is moved to the illustrated fully open position. With the handle 26 and frame member 24 in their appropriate positions for loading the liner, the liner is inserted into the opening 14 and attached to the spool 40. An open end of the liner is then folded back over the housing 12 and frame member 24 in a manner similar to that in which a conventional waste basket liner is folded over the rim of a conventional waste basket.

To pick up waste, the device 10 is rolled on wheels 100 toward or angled slightly relative to the surface or ground being cleaned and positioned so that the opening 14 is adjacent the waste desired to be picked up. A front edge or lip 18*a* of the lower wall 18 is partially inserted between the waste and the ground or surface supporting the waste. Although not illustrated, the lip 18*a* could extend forward from the housing 12 a distance greater than an edge or end of the sidewalls 20, 22, if desirable. With the edge 18*a* partially inserted, a portion of the waste rests on the liner folded over the edge.

Next, the actuating member 48 is actuated by applying at least an initial depression force thereon which allows power to flow from the batteries B to the motor 46. Provided the motor 46 and gear 50 are in the engaged position, wherein the gear 50 engages the spool gear 44, the motor 46 causes the spool 40 to rotate in the first direction. As mentioned above, rotation of the spool 40 in the first direction causes the liner to be wound about the outer barrel member 42 of the spool and pulled into the opening 14. At the same time, the housing 12 can be moved forward along or into the waste.

As the liner is wound about the spool 30, the waste is pulled into the device 10 onto the liner and the device is manually moved toward or into the waste to continue feeding the waste to the device. More specifically, the static friction between the waste and the liner is greater than and overcomes the static friction between the waste and the surface the waste is resting upon and the relatively weak gravitational resistance acting on the waste, if any, such that the waste is pulled into the device 10 as the liner is pulled toward the spool 40. The gravitational forces, if any, resisting pulling of the waste toward the spool 40 are relatively weak because the device 10 is, at most, only slightly angled relative to the surface on which the waste rests when utilized for removing waste, or may not be angled at all. Depression of the actuating member 48 can continue, thereby continuing to pull the liner around the spool, until the waste is fully received in the housing 12.

Concurrent with or sometime after applying the initial depression force, the actuator member 48 can be further depressed to mechanically move the frame member 24 toward the closed position via the arm 64 and lever 68 as described above. Such movement of the frame member 24 causes it to capture the waste being pulled into the device 10 like a claw. Thus, as the rotating spool 40 pulls the liner and frictionally engaged waste into the device, the frame member 24 closes and brings a portion of the liner folded thereover over the waste thereby facilitating removal of the waste into the device.

Figure 4:
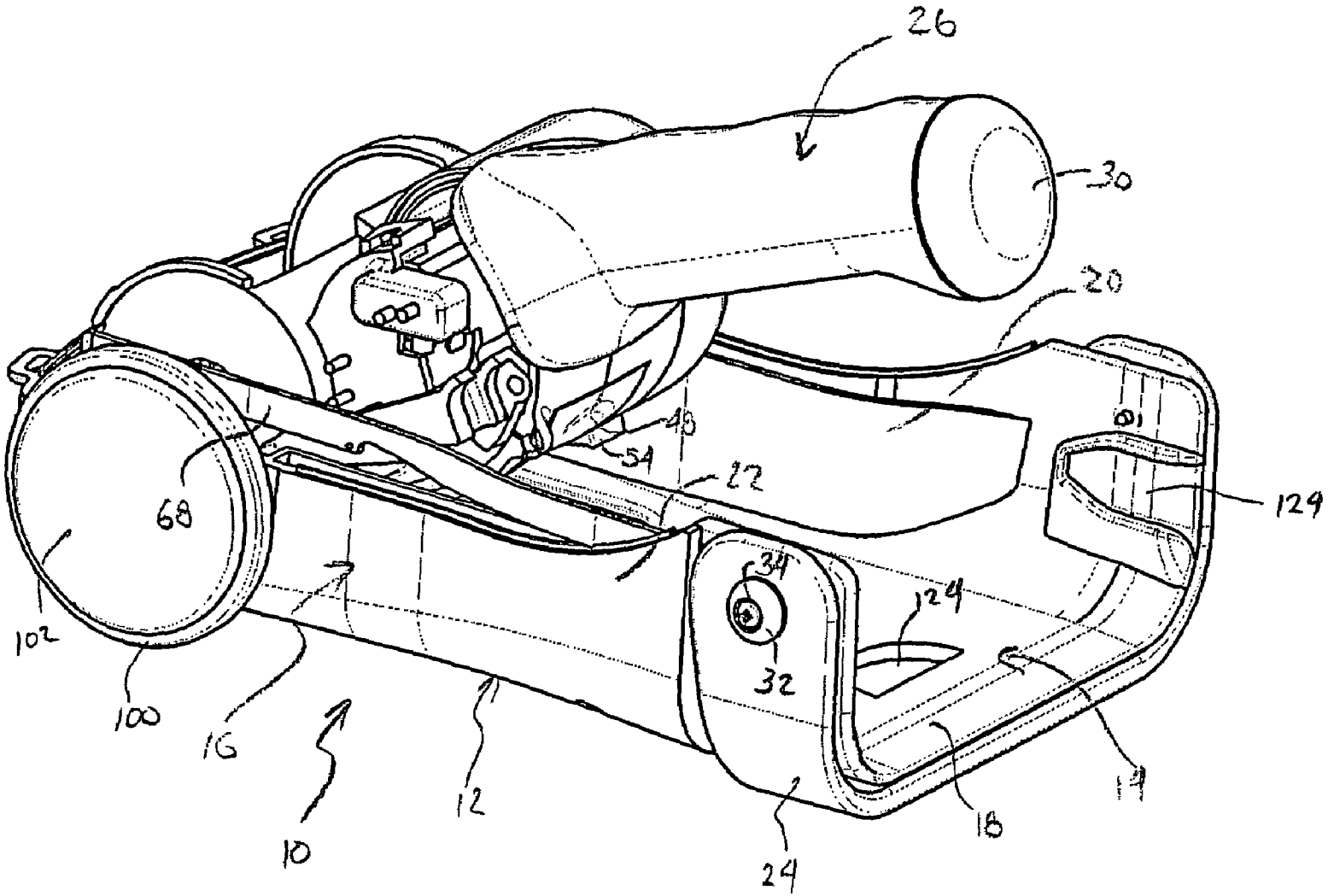
FIG. 4 is a front perspective view of the waste collection device of FIG. 3 showing the device in an intermediate folded-open position with a portion of a housing removed.

Once the waste is pulled into the device 10, the frame member 24 can be moved to its fully closed or nesting position. This action causes the liner to completely fold over the edge 18*a* adjacent the open end 14 of the device thereby sealing the liner closed. This traps any waste collected in the liner until it is desired to remove the waste from the device. Note that the device can be held in any orientation without fear of spillage of the liner's contents, as long as the liner is pinched between the frame member 24 and the housing 12. At this point, the handle 26 of the device 10 can be partially folded as shown in FIG. 4 for stowing the device, while, at the same time, not disturbing the waste held in the liner.

To remove the liner with the waste contained therein, it is first necessary to disengage the spool 40 from the motor 46. More particularly, a user applies force to the knob 54 to move the motor 46 and gear 50 to the disengaged position against the urging of spring 56 (see FIG. 5). The force is applied and held on the knob 54 maintaining the motor 46 and gear 50 in the disengaged position relative to the spool gear 44 and spool 40 connected thereto. While in the disengaged position, the user grasps the open end of the liner extending beyond the pinching caused by the frame member 24. The user holds the open end of the liner closed at least until the liner with the waste contained therein is removed.

Next, the frame member 24 is pivoted from the fully closed position to the fully open position. Then, with the motor 46 and gear 50 held in the disengaged position and the spool 40 free to rotate, the liner can be pulled from the body 12 and unwound from the spool 40 as it is pulled, i.e., the spool 40 rotates in the second direction. Once removed from the device, the liner with the waste therein can be discarded. If the liner is one of a roll of liners, the liner with the waste therein is detached from the remaining liners on the roll along a conventional perforated seam and a new liner of the roll can be prepared for subsequent use with the device 10.

The invention has been described with reference to one or more embodiments. Obviously, modifications and alterations will occur to others upon reading and understanding the preceding detailed description. It is intended that the invention be construed as including all such modifications and alterations as come within the scope of the appended claims and the equivalents thereof.

What is claimed is:

1. A waste collection device, comprising:

a body including a housing defining an opening which allows an open end of an associated bag to be folded thereover, said body supporting a closed end of said associated bag;

a spool rotatably connected to said body and removably connected to said associated bag; and a driving mechanism connected to said spool for selectively rotating said spool such that the associated bag is wound on said spool thereby pulling said associated bag into said housing.

2. The waste collection device of claim 1 wherein said housing comprises a U-shaped base portion having a substantially flat lower wall and a pair of spaced apart side walls extending upward from said lower wall.

3. The waste collection device of claim 2 wherein said body includes a handle that is foldable between a folded-down position adjacent said lower wall and a folded-open position wherein said handle extends away from said lower wall.

4. The waste collection of claim 3 wherein at least one preselected position is provided between said folded-down position and said folded-open position, and wherein at least one of said handle and said housing includes at least one movable element which is received in a recess defined in the other of said one of said handle and said housing for holding said handle in said at least one preselected position.

5. The waste collection device of claim 1 wherein said driving mechanism comprises a motor.

6. The waste collection device of claim 5 further comprising:

a frame member movably mounted adjacent said opening of said housing that together with said housing forms said opening, said frame member being movable between an open position and a closed position; and an actuator member disposed on said body for operating at least one of said motor and said movable frame member.

7. The waste collection device of claim 6 wherein said actuator member is a two-function actuator member that electrically connects said motor to a power source upon initial depression and mechanically moves said frame member toward said closed position upon further depression.

8. The waste collection device of claim 7 further including at least one lever connected to said frame member to move said frame member upon depression of said actuator member, said at least one lever connected to said frame member at a location offset relative to an axis defined through a pivotal connection of said frame member to said housing, depression of said actuator member causing movement of said at least one lever to move said frame member toward said closed position, unless said frame member is positioned in said closed position.

9. The waste collection device of claim 6 further comprising a spring for urging said movable frame member towards one end position in relation to said housing.

10. The waste collection device of claim 1 further including:

a frame member movably mounted adjacent said opening of said housing that together with said housing forms said opening, said frame member being movable between an open position and a closed position; and an actuator member disposed on said body for operating said movable frame member, said actuator member selectively engaging at least one lever connected to said frame member to move said frame member upon depression of said actuator member, said at least one lever being connected to said frame member at a location offset relative to an axis defined through a pivotal connection of said frame member to said housing, depression of said actuator member causing movement of said at least one lever to move said frame member toward said closed position.

11. The waste collection device of claim of claim 9 further comprising a spring wherein said frame member is urged by said spring toward said open position when said frame member is in an intermediate position between said open position and said closed position.

12. The waste collection device of 9 wherein said frame member is manually movable between said open position and said closed position, wherein depression of said actuator member only moves said frame member to an intermediate position between said open position and said closed position.

13. The waste collection device of claim 1 wherein said spool includes an outer barrel member and an inner barrel member telescopingly received within said outer barrel member.

14. The waste collection device of claim 13 wherein at least one of said outer member and said inner member includes at least one tab and the other of said at least one of said outer member and said inner member includes at least one corresponding aperture into which said at least one tab is received for limiting relative rotation between said inner and outer members.

15. The waste collection device of claim 14 wherein said at least one tab includes a pair of diametrically opposed tabs and said at least one aperture includes a pair of diametrically opposed slots for guiding telescopic movement between said inner and outer members.

16. The waste collection device of claim 13 further comprising a spring which is disposed between an innermost end of said outer barrel member and an end of said inner barrel member that is received in said outer barrel member, wherein said spring urges said inner member toward an elongated position.

17. The waste collection device of claim 13 wherein at least one bag mounting aperture is defined in said outer barrel member and said inner barrel member such that an end of said associated bag can be threaded through said spool and tied off.

18. The waste collection device of claim 1 wherein said spool includes a first end comprising a socket and radially extending teeth which are selectively engageable with a spool gear of said driving mechanism.

19. The waste collection device of claim 1 wherein said body includes a frame member movably mounted adjacent said opening of said housing, said opening being defined by said housing and said frame member when said frame member is in an open position.

20. The waste collection device of claim 1 wherein said frame member is U-shaped and together with said housing forms said opening, said frame member being movable between a fully open position wherein said opening is fully defined and a fully closed position wherein said frame member nests around said housing for compact storage.

21. A waste collection device, comprising:

a body including a housing defining an opening which allows an open end of an associated bag to be folded thereover, said housing receiving a closed end of said associated bag therein;

a spool rotatably connected to said body and removably connected to said associated bag; and a motor selectively connected to said spool for selectively rotating said spool such that the associated bag is wound on said spool thereby pulling said associated bag into said housing.

22. The waste collection device of claim 21 further including a transmission assembly that selectively connects an output of said motor to said spool so said spool is rotated by said motor when said motor is actuated.

23. The waste collection device of claim 22 wherein said transmission assembly includes a motor and gear mounting arrangement which is movably mounted relative to said housing so that it is movable between an engaged position wherein said gear is operatively engaged with said spool so that powered rotation from said motor effects rotation of said spool and a disengaged position wherein said gear is disengaged from said spool allowing manual rotation of said spool, said connection assembly further including a spring urging said motor and gear toward said engaged position and a disengaging knob for manually moving said motor and said gear toward said disengaged position against urging of said spring.

24. The waste collection device of claim 21 wherein said body includes a handle that is movable between a folded-down position and a folded-open position.

25. The waste collection device of claim 24 further comprising a switch which prevents operation of said motor unless said handle is in said folded-open position.

26. A waste collection device, comprising:

a body including a U-shaped housing having an open end;

a frame member pivotally secured to said housing adjacent said open end, said frame member being movable toward an open position for defining an opening together with said U-shaped housing;

a spool rotatably connected to said body at a location spaced from said open end; and a bag having a bag closed end adapted to be secured to said spool and a bag open end adapted to be passed through said housing open end and folded over said housing and said frame member, wherein rotation of said spool winds said bag thereon and pulls said bag open end into said housing open end.

* * * * *